United States Patent [19]
Beilke
[11] 4,318,292
[45] Mar. 9, 1982

[54] PROCESS FOR MANUFACTURING TONGUE AND GROOVE PLIERS

[75] Inventor: Reuben M. Beilke, Defiance, Ohio
[73] Assignee: Dresser Industries, Inc., Dallas, Tex.

[21] Appl. No.: 259,293
[22] Filed: Apr. 30, 1981
[51] Int. Cl.[3] ..... B21D 22/00
[52] U.S. Cl. ..... 72/356; 72/374; 76/101 D; 81/414
[58] Field of Search ..... 72/356, 360, 376, 474; 81/414; 76/101 D, 114

[56] References Cited

U.S. PATENT DOCUMENTS 4,204,419 5/1980 Cole ..... 72/356

*Primary Examiner*—Leon Gilden
*Attorney, Agent, or Firm*—Roy L. Van Winkle

[57] ABSTRACT

A manufacturing process for tongue and groove pliers that involves forging plier members with a bend between the nose and handle portions, forging arcuate projections on the members with mating surfaces on the projections. The surfaces having an angular orientation relative to the adjacent plier surface of 90° minus an angle that is less than the supplement of the angle of the bend, and straightening the members so that the mating surfaces, when engaged, tend to urge said plier members relatively toward each other.

5 Claims, 11 Drawing Figures

PROCESS FOR MANUFACTURING TONGUE AND GROOVE PLIERS

BACKGROUND OF THE INVENTION

This invention relates generally to an improved process for manufacturing tongue and groove pliers. More particularly, but not by way of limitation, this invention relates to a process for forging mating surfaces on the tongue and groove pliers that interact to urge the plier members relatively together when in use.

Tongue and groove or adjustable pliers have been in use in the industry for many years. One of the disadvantages of such pliers has been the tendency to bind and damage or destroy the pivot pin or fastener connecting the plier members due to the forces generated when gripping a work piece.

This problem has been recognized, and H. H. Manning in U.S. Pat. No. 2,640,381, which issued June 2, 1953, provided for the construction pliers having mating surfaces oriented along angular planes that tend to urge the plier halves relatively together when gripping a work piece. In other words, Manning discloses the use of a "negative angle" on the mating surfaces so that the plier members are in a sense interlocking.

Manning presented a method of solving the problem of the lateral loads, that is loads that tended to break or damage the pivot pin, but his solution created a problem of to how to manufacture the pliers with such "negative angles". Generally, the pliers are forged and the forging of negative angles is an extremely difficult procedure.

The pliers, constructed in accordance with the Manning patent, has the negative angles formed by machining of the arcuate projections after forging. The machining operation is not only expensive, but it also weakens the pliers somewhat as compared to purely forged pliers.

U.S. Pat. No. 3,739,664 issued June 19, 1973 to John E. Swanstrom, Jr., describes a method of forging tongue and groove pliers with negative angles thereon. It is believed that the procedures utilized in the Swanstrom method of forming the negative angles will result in a shorter die life and thus, ultimately, increase the cost of the pliers.

SUMMARY OF THE INVENTION

This invention provides a tongue and groove plier that is manufactured purely by forging and one that includes the desired "negative angles" on the mating surfaces of the arcuate projections on the plier members.

This invention provides a process for manufacturing tongue and groove pliers wherein the process comprises the steps of forging plier members with a bend between the nose and handle portions, forging arcuate projections on one surface of the nose portion and simultaneously forging a mating surface on each of the projections that is disposed at an angle relative to the one surface that is 90° minus an angle that is less than the supplement of the angle of the bend between the nose and handle portions. It further contemplates the straightening of the plier members to place the mating surfaces in position for engagement whereby the mating surfaces, when in engagement, tend to urge the plier members toward each other.

BRIEF DESCRIPTION OF THE DRAWING

The foregoing and additional objects and advantages of the invention will become more apparent when the following detailed description is read in conjunction with the accompanying drawing, wherein like reference characters denote like parts in all views, and wherein.

DETAILED DESCRIPTION OF THE PREFERRED EMBODIMENT

Figure 1:
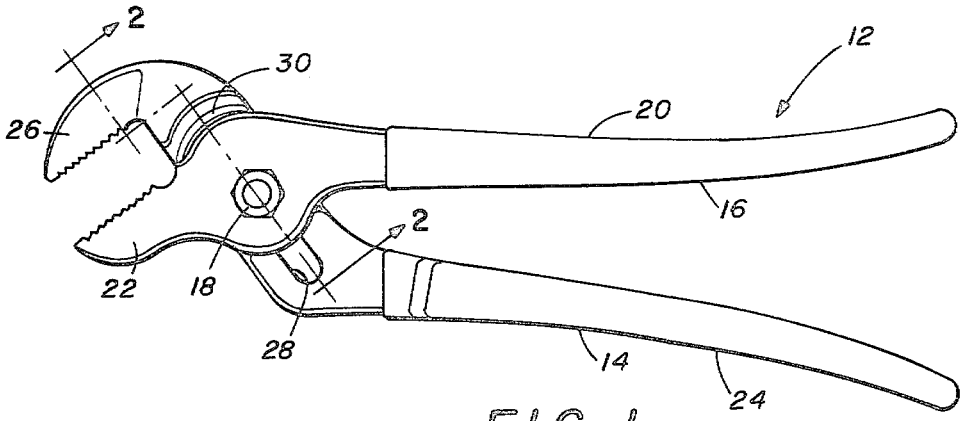
FIG. 1 is a pictoral representation of a tongue and groove plier constructed in accordance with the invention.
Figure 3:
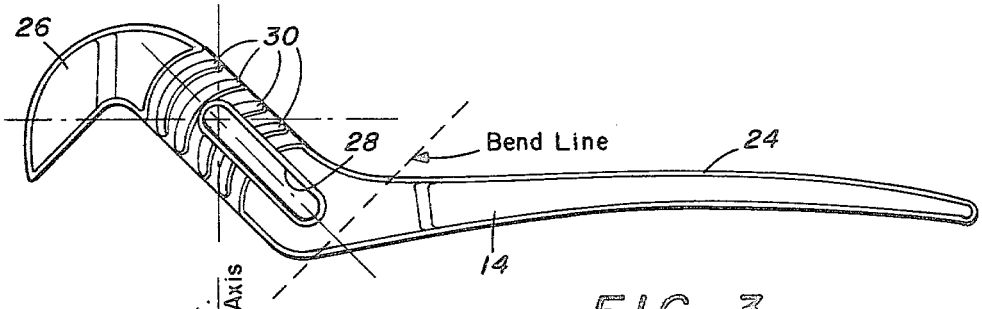
FIG. 3 is a plan view of the groove half of the plier that is constructed in accordance with the invention.

Referring to the drawing, and to FIG. 1 in particular, shown therein and generally designated by the reference character 12, is a tongue and groove plier that is constructed in accordance with the invention. As shown therein, the plier 12 includes a groove half 14 and a tongue half 16 that are pivotally interconnected by a threaded fastener 18.

The tongue half 16 of the plier 12 includes a handle portion 20 and a nose portion 22. Similarly, the groove half 14 of the plier 12 includes a handle portion 24 and a nose portion 26. The groove half 14 of the plier 12 has an elongated slot 28 formed therein for purposes that will become more apparent hereinafter.

Figure 2:
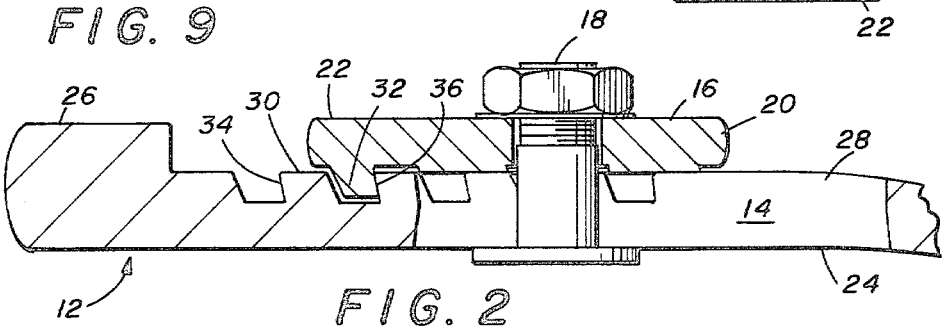
FIG. 2 is a cross-sectional view taken along the line 2—2 of FIG. 1.

As can be seen in FIG. 2, the groove half 14 of the plier 12 includes a plurality of arcuate projections 30. The arcuate projections 30 are arranged to mate with a single arcuate projection 32 that is located on the tongue half 16 of the plier 12. The details of the projections 30 and 32 will be discussed more fully hereinafter.

In the enlarged cross-sectional view of FIG. 2, it can also be seen most clearly that each of the arcuate projections 30 is provided with a surface 34 that mates with a surface 36 formed on the single projection 32 of the tongue half 16 of the plier 12. The mating surfaces 34 and 36 are disposed at acute angles with respect to the adjacent surfaces of plier halves 14 and 16 or to a horizontal line as seen in FIG. 2, so that when in engagement, the tongue half 16 and the groove half 14 tend to move relatively together avoiding the imposition of axial loads on the threaded fastener 18.

Figure 4:
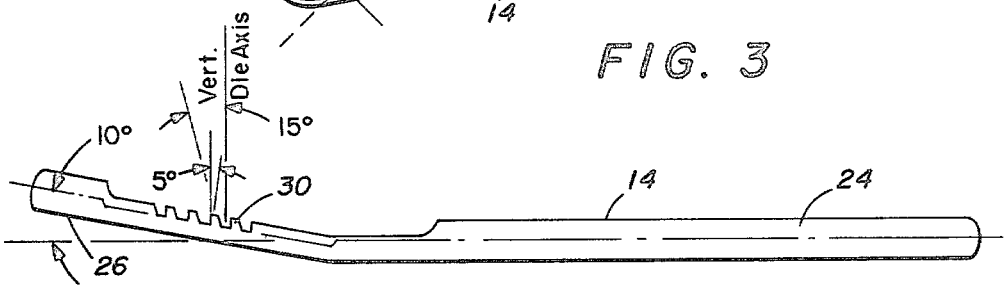
FIG. 4 is a side view of the groove half of the plier shown in FIG. 3.
Figure 5:
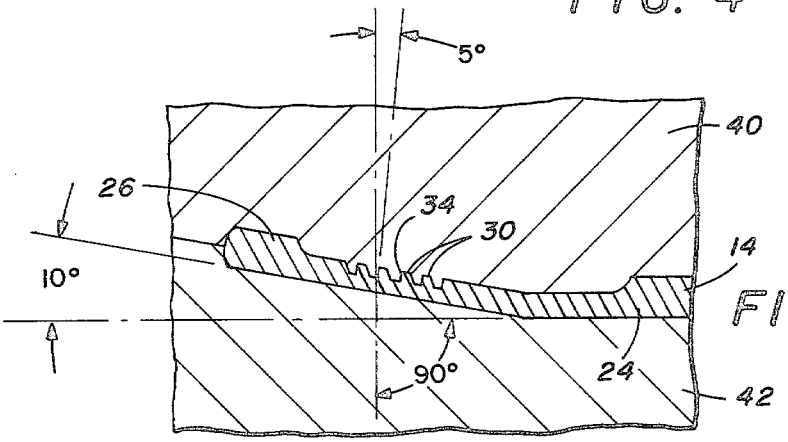
FIG. 5 is a partial cross-sectional view showing the groove half of the plier of FIG. 4 between mating dial portions of the forging dies.

FIGS. 3 through 6 show the groove half 14 of the plier 12 in various stages of manufacture. As illustrated in FIG. 5, mating forging dies 40 and 42 are formed in such a manner that the groove half 14 is bent at an angle of approximately 170° between the nose portion 26 and the handle portion 24, that is, along the dash line in FIG. 3. The angle of bend may be different from 170°, but it has been found that supplement to that angle, that is 10°, works very satisfactorily. The surfaces 34 in the projections 30 are disposed at an angle of approximately 5° with respect to the vertical as seen in FIG. 5. Five degrees has been selected because this is a convenient draft angle permitting easier forging of the arcuate projections 30. The opposite surface of the arcuate projections is provided with a significantly larger angle, although this is unimportant with respect to the operation of the plier 12, except that it should appear as a positive forging angle.

After the initial forging operation, the groove half 14 of the plier 12 is in the configuration illustrated in FIG. 4. Shearing or flashing dies (not shown) are then utilized with the groove half 14 to remove any flashing that occurs as result of the forging operation.

Figure 6:
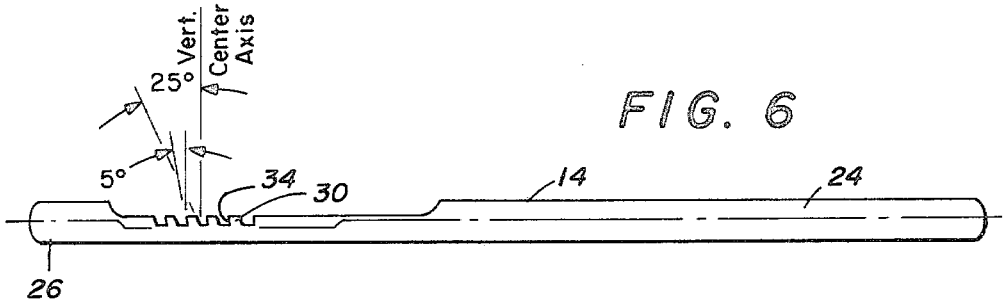
FIG. 6 is a side view similar to FIG. 3, but illustrating the groove half of the plier after straightening.

After the flashing has been removed, the groove half 14 is placed in a coining or straightening die (not shown) wherein the 170° bend is removed and the groove half 14 assumes the configuration illustrated in FIG. 6.

Since the angle of the bend with respect to horizontalin the groove half 14 was approximately 10°, and the angle of the mating surface with respect to vertical was positive 5°, straightening the 10° angle causes the mating surface 34 of the arcuate projections 30 to assume a negative 5° angle with respect to the vertical. With respect to horizontal, this surfaces 34 now form acute angles. Stated in another way, the angle will be, in the example given, 85° with respect to the adjacent surface of the plier 12.

Figure 7:
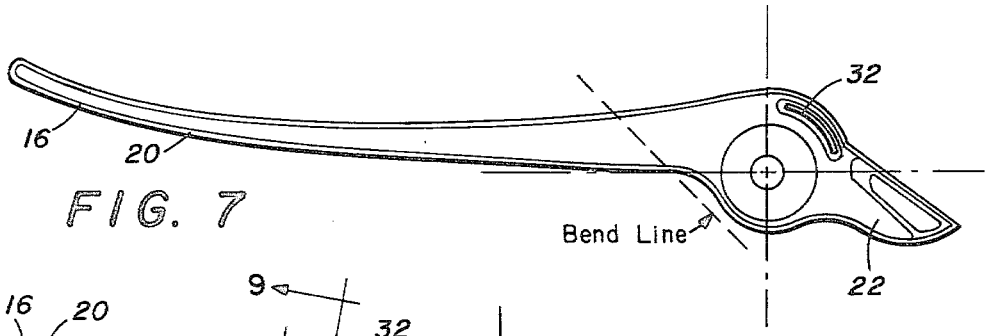
FIG. 7 is a plan view of the tongue half of the plier that is also constructed in accordance with the invention.
Figure 8:
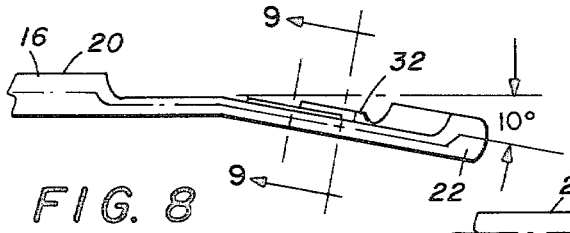
FIG. 8 is a side view of the tongue half of the plier of FIG. 7 illustrating the plier member as forged.

FIGS. 7 through 11 are similar to FIGS. 3 through 6, except that they illustrate the manufacturing of the tongue half 16 of the plier 12. FIG. 7 is a plan view of the tongue half 16 with the 170° bend (see FIG. 8) located between the nose portion 22 and the handle portion 20 or approximately where the dash line crosses the tongue half 16 in FIG. 7. It should be noted that the bend in the tongue half 16 is in the opposite direction as compared to the bend in the groove half 14 of the plier 12.

Figure 9:
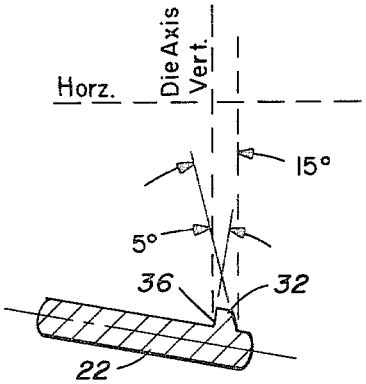
FIG. 9 is a cross-sectional view taken along the line 9—9 of FIG. 8.

In the cross-sectional view of FIG. 9, the angular orientation of the surface 36 on the arcuate projection 32 can be clearly seen. It will be seen in that Figure that the mating surface 36, in the bent condition of the tongue half 16, would appear to the forging dies as a positive 5° draft angle.

Figure 10:
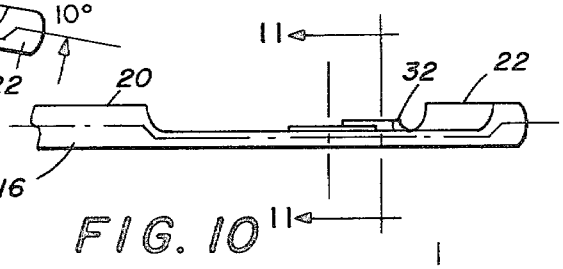
FIG. 10 is a side elevation view of the tongue half of the plier after straightening.
Figure 11:
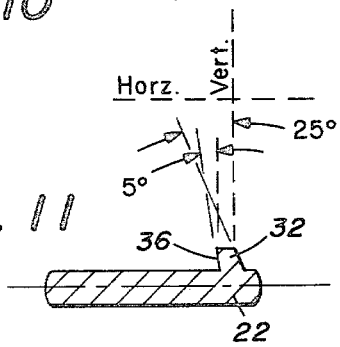
FIG. 11 is a cross-sectional view of the tongue half of the plier taken along the line 11—11 of FIG. 10.

In FIG. 10, the plier half 16 is illustrated in the condition that it occupies after the tongue half 16 has been through the shearing or flashing dies and after coining or straightening. The effect of straightening the bend can be appreciated from the cross-section shown in FIG. 11. As shown therein, it can now be seen that the mating surface 36 forms a 5° angle with the vertical in a direction opposite to that occupied by the surface 36 when the tongue half 16 was in the bent condition illustrated in FIG. 8. Stated in another way, the angle of the mating surface 36 is 85° with respect to the adjacent surface of the plier 12 or to horizontal as shown in FIG. 11.

The bending of of the plier halves by 10°, as previously mentioned, is not the only angle that can be utilized, but one that has been found to work conveniently. Similarly, the 5° angle on the mating surfaces 34 and 36 has been selected because it provides a convenient draft angle for the forging dies. However, it should be pointed out that the mating surfaces 34 and 36 can be disposed at any angle so long as it is less than the supplement of the angle of the bend.

In any event, the process described provides a method of forming the negative angles desired on the pliers 12 while presenting to the forging dies positive draft angles. Thus, an extremely strong plier is formed and the optimum in die efficiency is obtained due to the ability to forge with the positive draft angles.

Having described but a single embodiment of the invention, it should be pointed out that it is presented by way of example only and that many changes can be made therein without departing from the spirit of the invention.

The embodiments of the invention in which an exclusive property or privilege is claimed are defined as follows:

1. A process for manufacturing tongue and groove pliers that includes a pair of plier members that are pivotally connected, each plier member including a handle portion and a nose portion, each nose portion being provided with one or more arcuate projections and each arcuate projection including a mating surface oriented to move said plier members relatively toward each other when in engagement, said process comprising the steps of:

forging said plier members with a bend between said nose and handle portions, forging said arcuate projections on one surface of said nose portion and simultaneously forging a mating surface on each said projection that is disposed at an angle relative to said one surface that is 90° minus an angle that is less than the supplement of the angle of the bend between said nose and handle portions; and, straightening the plier members to place said mating surfaces in position for engagement whereby said mating surfaces, when in engagement, tend to urge said plier members toward each other.

2. The process of claim 1 wherein said plier members include first and second plier members and including:

forging at least one projection on the surface of a first of said plier members opposite to the direction of the bend between the nose and handle portions of said first plier member; and, forging at least one projection on the surface of a second plier member in the same direction as the direction of bend between the nose and handle portion of said second plier member.

3. The process of claims 1 or 2 wherein said pliers are bent so that supplement of the angle between the nose and handle portions is about 10°.

4. The process of claims 1 or 2 wherein said mating surfaces are disposed at less than 90° by approximately ½ the supplement of the angle of the bend.

5. The process of claim 3 wherein said mating surfaces are sidposed at less than 90° by approximately ½ the supplement of the angle of the bend.

* * * * *